United States Patent [19]

Levin et al.

[11] 3,953,252

[45] Apr. 27, 1976

[54] METHOD OF MANUFACTURING METAL ARTICLES HAVING MAGNETIC AND NON-MAGNETIC AREAS

[76] Inventors: Felix Lvovich Levin, Novo-Khoroshevskoe shosse, 26 korpus 3, kv. 29; Sergei Alexandrovich Golovanenko, 9 Parkovaya ulitsa, 57, korpus 3-a, kv. 12; Vladimir Alexandrovich Dmitriev, ulitsa Plekhanova, 3, korpus 5, kv. 73, all of Moscow, U.S.S.R.

[22] Filed: Oct. 17, 1974

[21] Appl. No.: 515,663

Related U.S. Application Data

[63] Continuation of Ser. No. 365,177, May 30, 1973, abandoned.

[52] U.S. Cl. ..... 148/121; 148/39; 148/120; 148/145; 148/148

[51] Int. Cl.[2] ..... H01F 1/00

[58] Field of Search ..... 148/121, 120, 108, 31.55, 148/148, 129, 145, 39; 75/170, 126 B; 346/74 MT

[56] References Cited

UNITED STATES PATENTS

| | | | |
|---|---|---|---|
| 2,002,689 | 5/1935 | Bozorth et al. | 148/31.55 |
| 2,382,651 | 8/1945 | Nesbitt | 75/126 B |
| 2,765,161 | 10/1956 | Mungall | 148/108 |
| 3,047,382 | 7/1962 | Harpster | 75/170 |
| 3,707,001 | 12/1972 | Notley | 346/74 MT |
| 3,736,131 | 5/1973 | Espy | 75/126 B |
| R20,421 | 6/1937 | Payson | 148/121 |

OTHER PUBLICATIONS

Young, J.; *Materials & Processes*, New York, 1954, pp. 711–715.

Grossman, M.; *Principles Of Heat–Treatment;* ASM, Cleveland, 1935, pp. 101–103 & 195–196.

Bozorth, R.; *Ferromagnetism*, New York, 1951, pp. 6, 8–10, 15 & 16, & 713–719.

*Primary Examiner*—Walter R. Satterfield

*Attorney, Agent, or Firm*—Holman & Stern

[57] ABSTRACT

A method of manufacturing metal articles having magnetic and non-magnetic areas comprises the thermal treatment of an all-metal blank made of a metal capable of forming a non-magnetic structure as a result of ageing and of becoming magnetic after high-temperature hardening. The areas intended to form the non-magnetic structure are heated to a temperature ranging from 450° to 1000°C, soaked to form the non-magnetic structure and then cooled, while the areas intended to form the magnetic structure are heated to a temperature ranging from 1000°C to the melting temperature of the metal to preserve the uniformity of the blank, and then cooled at a rate preventing the formation of the non-magnetic structure.

12 Claims, No Drawings

METHOD OF MANUFACTURING METAL ARTICLES HAVING MAGNETIC AND NON-MAGNETIC AREAS

This is a continuation of application Ser. No. 365,177, filed May 30, 1973 and now abandoned.

BACKGROUND OF THE INVENTION

The present invention relates to a method of manufacturing metal articles having magnetic and non-magnetic areas.

Such articles are widely used as elements for various machine and instruments. They are manufactured (or assembled) from metals possessing different or contrasting properties such as, for example, magnetic and non-magnetic properties, high and low electrical resistant capacities, different ratios of thermal expansion, different Curie point values and different characteristics of strength and ductility. The metals possessing the above properties are joined by welding, soldering, riveting, glueing, pouring, plating, and by mechanical connection such as pressure treatment in a hot and cold state.

Yet, the methods used result in deterioration of the properties of the compounds which contribute to the formation of the magnetic and non-magnetic areas of the article. Besides, manufacturing articles consisting of separate parts involves certain technological complications. Thus, the metals assembled by welding have different crystal structures, for example, austenitic steel for the non-magnetic areas and open-hearth steel for the magnetic areas. The austenitic steels are welded at lower arc heat inputs and at maximum possible rates of cooling to avoid the formation of hot cracks, while the open-hearth steels require welding at higher arc heat inputs and must be accompanied by tempering or heating to prevent the formation of cold cracks. But when both magnetic and non-magnetic steels are welded by any of the above methods the properties of strength, ductility and impact strength of at least one of the components becomes inferior. Besides, in the course of welding the temperatures of the steels reach values which are close to the melting temperature and the original structure of the steels changes as a result, and the magnetic properties acquired by the article in the transitional zone are uncontrollable. The local mixing of the metal also makes the properties of joint-filling metal uncontrollable. The strength of the weld joint, as a rule, is inferior to that of the basic metal. For some structures welding is inapplicable while for some heterogeneous metals it involves certain complications or is impossible in practice.

The appropriate strength of an article manufactured from two different grades of steel can be attained by joining the components by a hot-and-cold pressure treatment or by pouring one into the other. Such a monolithic article (bimetal), however, consists of metals which differ in their crystal structures, i.e. the non-magnetic structure of the austenitic steel and the magnetic structure of the open-hearth steel. The thermal treatment of the bimetal results in deterioration of the magnetic and mechanical properties of at least one of the components, therefore, it is very difficult and sometimes impossible to improve the properties of the magnetic and non-magnetic areas by thermal treatment.

The mechanical assembling and glueing of magnetic and non-magnetic metals cannot insure high reliability, durable strength and proper working abilities of the article thus produced.

It is common knowledge that when an article made of a magnetic metal is subjected to heating its magnetic properties weaken; yet, attempts to put a magnetic blank of stainless steel through local thermal treatment did not give the desired results because the article still had some magnetic areas, so attempts to obtain areas devoid of any magnetic properties ended in failure and the articles thus produced were unfit for practical use.

One difficulty was to select a proper component and then to determine appropriate conditions of thermal treatment.

The inventors of the present invention disclose in application Ser. No. 346,884 a method of manufacturing metal articles having magnetic and non-magnetic areas comprising the thermal treatment of areas of an all-metal blank heating some of the areas to a temperature ranging from 450° to 1000° C and heating the other areas to a temperature of from 1000° C to the melting temperature of the metal to preserve its uniformity.

The above method gave results superior to those of the previous methods, and the method described in the present invention is its developed version.

SUMMARY OF THE INVENTION

The main object of the present invention is to provide a method of manufacturing a monolithic article having magnetic (B = 12,000 – 18,000 G) and non-magnetic ($\mu = 1.0$ G/oersted) areas.

Another important object is to simplify the technological process of manufacturing the article and to manufacture the article cheaper.

Still another object is to provide for the manufacture of articles having small magnetic and non-magnetic areas.

These and other objects have been attained with the introduction of a method of manufacturing metal articles having magnetic and non-magnetic areas comprising a thermal treatment of areas of an all-metal blank, heating some of the areas to a temperature ranging from 450° to 1000° C and heating other areas from over 1000° C to the melting temperature of the metal blank to preserve its uniformity. According to the present invention the method requires the utilization of a blank manufactured from a metal capable of forming a non-magnetic structure as a result of ageing and of becoming magnetic after high-temperature hardening. The areas intended to form non-magnetic structure are heated to a temperature ranging from 450° to 1000° C, then soaked and cooled while the areas intended to form magnetic structure are heated to a temperature ranging from 1000° C to the melting temperature of the metal to preserve its uniformity, then soaked to form the magnetic structure and cooled at a rate to prevent the formation of the non-magnetic structure.

This method makes it possible to produce articles having magnetic ($\mu > 1.0$) and non-magnetic ($\mu = 1.0$) areas, manufactured from monolithic metal blanks.

It is recommended that the areas intended to form the magnetic structure be pre-heated to a temperature of 1050°–1350° C, soaked until the temperature is equalized along their entire areas sections and then cooled. As a result, the areas will have a more uniform structure and more stable magnetic properties.

It is recommended that a blank have the following composition (in weight percent: carbon — not more than 0.1; manganese — 7–12; chromium — 11–30; and the rest iron. Such a blank is capable of forming a non-magnetic structure as a result of ageing and a magnetic structure after high-temperature hardening.

It is recommended to utilize a blank having 3–5 wt percent of nickel. This will improve the auctility and impact strength of the article.

It is recommended to utilize a blank manufactured from a metal alloyed with 1–5 wt percent of molybdenum tungsten or niobium. This will raise the corrosion-resistant abilities of the articles in sea water and other aggressive media and will improve their magnetic characteristics.

It is desirable to utilize aa blank having 1 wt percent of titanium. This will improve the magnetic properties of the article and will make its finely-dispersed structure more pronounced.

It is recommended that during the formation of the magnetic structure the blank down be cooled down in a magnetic field. This will increase the quantity of the magnetic component and, as a result, will improve the magnetic characteristics of the magnetic areas.

Given below examples describing the present invention in detail.

If an article is manufactured from a metal capable of forming a magnetic structure as a result of ageing and of acquiring magnetic properties after high-temperature hardening it is sufficient to put the areas of the blank through an appropriate local thermal treatment. The areas intended to form the magnetic structure are heated to a temperature ranging from 1000° C to the melting temperature of the metal to preserve its uniformity and then cooled at a rate which prevents the formation of a non-magnetic structure. The areas intended to form the non-magnetic structure are heated to a temperature ranging from 450° to 1000° C, soaked until a full break-down of the magnetic structure occurs and then cooled.

It is possible to put the whole blank through a thermal treatment which will make it magnetic and then put the areas intended to form the non-magnetic structure through a local thermal treatment to make them non-magnetic, with the areas not subjected to local treatment remaining magnetic.

If an article is manufactured from a non-magnetic metal possessing the above properties, the local treatment will be sufficient to let the areas acquire magnetic properties and to produce a monolithic article having magnetic and nonmagnetic areas.

There are possibilities of manufacturing a steel capable of forming a non-magnetic structure as a result of ageing and of forming a magnetic structure after high-temperature hardening. Examples of the chemical composition of such a steel are given below. The steel may have additional components for improving its corrosion resistance, saturation induction, magnetic permeability, specific electric resistance, structural stability and mechanical properties.

DETAILED DESCRIPTION OF PREFERRED EMBODIMENTS

EXAMPLE 1

A cylinder-shaped steel blank having the following chemical composition in wt percent: carbon 0.05; silicon 0.30; manganese 11.04; chromium 26.67; and the rest iron was heated to 1100° C and soaked until the temperatures were equalized along the entire section of the blank and then cooled in water to secure the high-temperature state. Then the blank was heated to 700° C and soaked for 20 hours to produce a break-down of the magnetic component throughout the whole volume of the blank. The local thermal treatment was carried out by passing an industrial-frequency current through a part of the cylinder-shaped blank, 8mm in dia and 120 mm long, for 2 – 9 seconds. The area through which the current was passed, i.e. an area, 75 mm long between the current-conducting terminals, was heated to 1100° C and the magnetic structure formed. Then the current was switched off and the bank was cooled in water. The locally treated area had the following induction /B/ and magnetic permeability /$\mu$/ in the field of a magnetic intensity of 150 oe: $B_{150}$ = 8500–9500 G; $\mu$ = 58 –57 $^G$/oe.

EXAMPLE 2

A plate-shaped steel blank having the following chemical composition in wt percent: carbon — 0.07; silicon — 0.35; manganese — 10.5; chromium — 18.91; nickel — 4.36; vanadium — 2.10; and the rest iron was heated to 1100° C until the temperatures were equalized along its entire section and the cooled in water to secure the high-temperature state. Then the blank was heated to 700° C and soaked for 2 hours to provide for a break-down of the ferritic component throughout the whole volume of the blank. The local treatment was carried out of passing an industrial-frequency current through a part of the plate-shaped blank, 3 mm thick, 120 mm long, and 50 mm wide, for 2 – 9 seconds. The area through which the current was passed, i.e. an area, 60 mm long between the current-conducting terminals, was heated to 1100° C and cooled in water. The locally treated area acquired the properties of a magnetically soft material.

EXAMPLE 3

A steel having the following chemical composition in wt percent: carbon — 0.05; manganese — 6.58; silicon – 0.45; chromium — 25.83; nickel — 4.30; titanium — 0.76; and the rest iron was smelted in a high-frequency induction electric furnace. Then a blank made of the steel, 8 mm in diameter and 120 mm long, was heated to 700° C and soaked for 10 hours. There was a break-down of the ferritic component throughout the whole volume of the blank. The local thermal treatment was carried out at induction frequency $f$ = 440 kc and a capacity N = 10 kW by passing high-frequency currents through the blank which was thus heated to 1100° C. The magnetic properties of the steel in the magnetic areas were as follows: saturation induction B = 16 000 G, $B_{25}$ = 3 000 G, $B_{150}$ = 11, 000 G; coercive force $H_c$ = 0.78 oe.

EXAMPLE 4

A steel having the following chemical composition in wt percent: carbon — 0.035; manganese — 6.50; silicon — 0.47; chromium — 13.83; nickel — 4.30; titanium — 0.52; niobium — 3.87; and the rest iron was smelted in a high-frequency induction electric furnace. Then a part of a blank made of the steel, 8 mm in diameter and 120 mm long, was heated to 1000° C, soaked until the temperatures were equalized along the entire section of the blank and then cooled in water. The remaining areas were heated with high-frequency currents to 1200° C. The locally treated areas in which the temperature was 1200° C formed a magnetic structure while the remaining areas formed a non-magnetic structure.

EXAMPLE 5

A steel having the following chemical composition in wt percent: carbon — 0.018; manganese — 6.35; silicon — 0.37; chromium — 13.56; nickel — 4.43; titanium — 0.82; tungsten — 4.02; and the rest iron was smelted in a high-frequency induction electric furnace. Then a part of a blank made of the steel, 8 mm in diameter and 120 mm long, was heated to 1000° C, soaked until the temperatures were equalized along the entire section of the blank and cooled in water. The remaining areas were heated with high-frequency currents to 1200° C formed a magnetic structure while the remaining areas formed a non-magnetic structure.

EXAMPLE 6

A steel having the following chemical composition in wt percent: carbon — 0.045; silicon — 0.35; manganese — 11.00; chromium — 19.29; nickel — 4.20; and the rest iron was smelted in a high-frequency induction electric furnace. After hot plastic deformation of a blank made of the steel had taken place at temperatures ranging from 1100° to 850° C, the blank was heated to 700° C and soaked at such a temperature for 2 hours. There was a break-down of the ferritic component throughout the whole volume of the blank. Then pre-set areas of the blank were heated with high-frequency currents to 1200° C, and after cooling in water formed the structure of a magnetic material. The remaining areas acquired the properties of a non-magnetic material.

What is claimed is:

1. A method of manufacturing an integral steel article having magnetic and non-magnetic areas comprising the steps of: selecting a steel article comprising, by weight, not more than 0.1% carbon, 7–12% manganese, 11–30% chromium and the balance being iron; heating areas of the steel article intended to form a non-magnetic structure to a temperature of from 450°–1000° C; soaking the areas; and cooling the areas to form a non-magnetic structure in the areas; heating areas of the steel article intended to form a magnetic structure to a temperature of from 1000° C to the melting point of the steel; soaking the areas to form a magnetic structure in the areas; and cooling the areas having the magnetic structure at a rate to prevent the formation of the non-magnetic structure.

2. The method as claimed in claim 1 further comprising the steps of: preheating the areas of the steel article intended to form the magnetic structure to a temperature of from 1050°–1350° C; soaking the areas until the temperature is equalized throughout the areas; and cooling the areas.

3. The method as claimed in claim 1 wherein the steel article further comprises 3–5 weight % nickel.

4. The method as claimed in claim 1 wherein the steel article further comprises 1–5 weight % of a metal selected from the group consisting of molybdenum, tungsten and niobium.

5. The method as claimed in claim 1 wherein the steel article further comprises 1 weight % titanium.

6. The method as claimed in claim 1 wherein the steel article consists essentially of, by weight, 0.05% carbon, 0.30% silicon, 11.04% manganese, 26.67% chromium and the balance being iron.

7. The method as claimed in claim 3 wherein the steel article consists essentially of, by weight, 0.07% carbon, 0.35% silicon, 10.5% silicon, 10.5% manganese, 18.91% chromium, 4.36% nickel, 2.10% vanadium and the balance being iron.

8. The method as claimed in claim 3 wherein the steel article consists essentially of, by weight, 0.05% carbon, 6.58% manganese, 0.45% silicon, 25.83% chromium, 4.30% nickel, 0.76% titanium and the balance being iron.

9. The method as claimed in claim 3 wherein the steel article consists essentially of, by weight, 0.035% carbon, 6.50% manganese, 0.47% silicon, 13.83% chromium, 4.30% nickel, 0.52% titanium, 3.87% niobium and the balance being iron.

10. The method as claimed in claim 3 wherein the steel article consists essentially of, by weight, 0.018% carbon, 6.35% manganese, 0.37% silicon, 13.56% chromium, 4.43% nickel, 0.82% titanium, 4.02% tungsten and the balance being iron.

11. The method as claimed in claim 3 wherein the steel article consists essentially of, by weight, 0.045% carbon, 0.35% silicon, 11.00% manganese, 19.29% chromium, 4.20% nickel and the balance being iron.

12. The method as claimed in claim 1 wherein the areas having the magnetic structure are cooled in a magnetic field.

* * * * *